United States Patent [19]

O'Sullivan et al.

[11] 4,020,772

[45] May 3, 1977

[54] PROCESS TO PROTECT PROCESS HEATER CASING FROM CORROSION

[75] Inventors: Thomas F. O'Sullivan, Montclair, N.J.; Paul Korwin, Flushing, N.Y.

[73] Assignee: The Lummus Company, Bloomfield, N.J.

[22] Filed: Jan. 22, 1976

[21] Appl. No.: 651,366

[52] U.S. Cl. ..... 110/56; 122/DIG. 1; 122/356

[51] Int. Cl.[2] ..... F23L 15/00

[58] Field of Search ..... 122/DIG. 1, 356, 333, 122/494; 110/56

[56] References Cited

UNITED STATES PATENTS

| | | | |
|---|---|---|---|
| 1,963,358 | 6/1934 | Foltz | 122/DIG. 1 |
| 2,007,230 | 7/1935 | Wade | 122/DIG. 1 |
| 3,135,247 | 6/1964 | Griffin | 122/356 |
| 3,352,289 | 11/1967 | Cunningham, Jr. et al. | 122/356 |
| 3,829,285 | 8/1974 | Beck | 122/DIG. 1 |
| 3,938,475 | 2/1976 | O'Sullivan et al. | 122/356 |

*Primary Examiner*—Kenneth W. Sprague
*Attorney, Agent, or Firm*—Alice L. Chen

[57] ABSTRACT

The disclosure describes wall for a direct fired heater which burns high sulfur fuels. The wall includes an inner casing lined internally with refractory and an outer casing spaced from the inner casing to provide, air space therebetween and means for controlling the rate of air flow thru the space. Proper selection of the refractory and proper control of the rate of air flow assure that the temperature of the inner casing is maintained above the dew points of sulfur oxides for any ambient condition. The casings are joined at their upper ends and an air opening is provided at the lower end of the outer casing whereby air is admitted to the air space. An adjustable air vent is provided at the upper end of the outer casing for control of casing temperature, when necessary. A plurality of horizontal baffles extend from the inner casing outward into the air space to inhibit re-circulation of air in the air space.

5 Claims, 4 Drawing Figures

PROCESS TO PROTECT PROCESS HEATER CASING FROM CORROSION

BACKGROUND OF INVENTION

Fuels used in refineries and petrochemical plants frequently contain sufficient sulfur to present corrosion problems. Walls of direct fired heaters are subject to corrosion when such high sulfur fuels are being burned. The corrosion is a result of condensation of sulfur oxides on the metal casings and combination of these sulfur oxides with water vapor whereby sulfuric and sulfurous acids are produced. These acids attack the metal casings from inside the heaters thus resulting in severe damage.

One effective way to avoid sulfur corrosion in a direct fired heater is to operate the heater with its metal casing temperature above the dew points of the sulfur oxides, thereby avoiding condensation of the sulfur oxides. However, such operation results in high heat losses from the heater and such operation cannot be maintained under all ambient conditions. Other approaches have been tried to prevent sulfur corrosion, including special coatings and special refractory linings, but none of these approaches have proven to be fully satisfactory.

STATEMENT OF INVENTION

Sulfur corrosion in direct fired heaters is solved by this invention in a particularly useful, novel, unobvious and facile way. A double casing is employed with an air space provided therebetween. An inner one of the casings is lined with refractory selected to maintain the inner casing at a temperature above the dew points of pertinent sulfur oxides, namely $SO_2$ and $SO_3$. The casings are joined at the upper ends with an adjustable opening which can be used to set the amount of air flowing thru the space between the inner and outer casing. Baffles are provided at intermediate levels partially blocking the air space between the casing to prevent natural convection air currents circulating from the inner to the outer wall, thus reducing its insulation effectiveness. A small amount of air as controlled by the top adjustable opening is permitted to pass the baffles. The entrance to the air space is via the lower end of the outer casing. With this double casing arrangement, several ambient variables affecting temperatures of the inner casing are eliminated so that it is feasible in practical terms to assure a temperature of the inner casing which is lined with insulation, above the dew points of sulfur oxides. Accordingly objects of this invention are to eliminate sulfur corrosion and to shield the inner casing from all ambient conditions, except air temperature (i.e. wind, precipitation, etc.), thus permitting more effective control of the temperature of the inner casing.

Another object of this invention is to improve thermal efficiency of the heater.

Still another object of this invention is to fabricate a heater wall employing inexpensive materials.

Still another object of this invention is to fabricate a heater wall which is simple to design, build and maintain.

Still another object of this invention is to fabricate a heater wall which is suitable otherwise to its intended function.

DESCRIPTION OF DRAWINGS

The foregoing and other objects, features and advantages will be seen more fully from a detailed description of a preferred embodiment of the invention which follows and from claims which also follow, all viewed in conjunction with accompanying drawings wherein:

DETAILED DESCRIPTION OF PREFERRED EMBODIMENT

Figure 1:
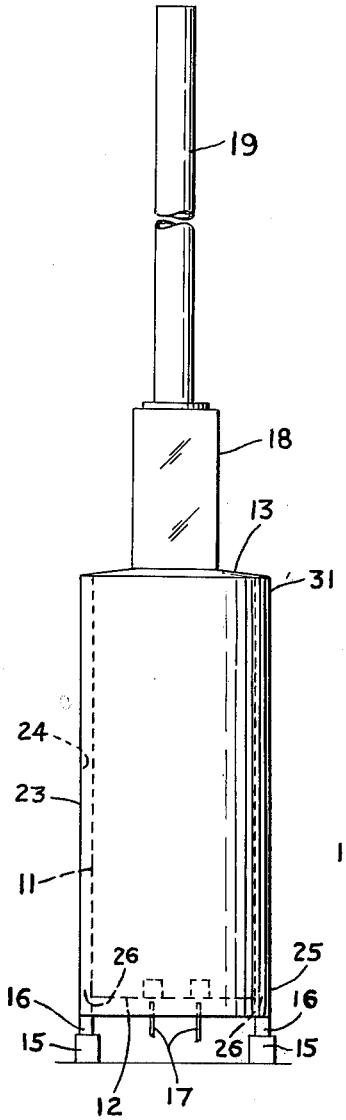
FIG. 1 is an elevational view of a vertical cylindrical direct fired heater in which this invention is incorporated.
Figure 2:
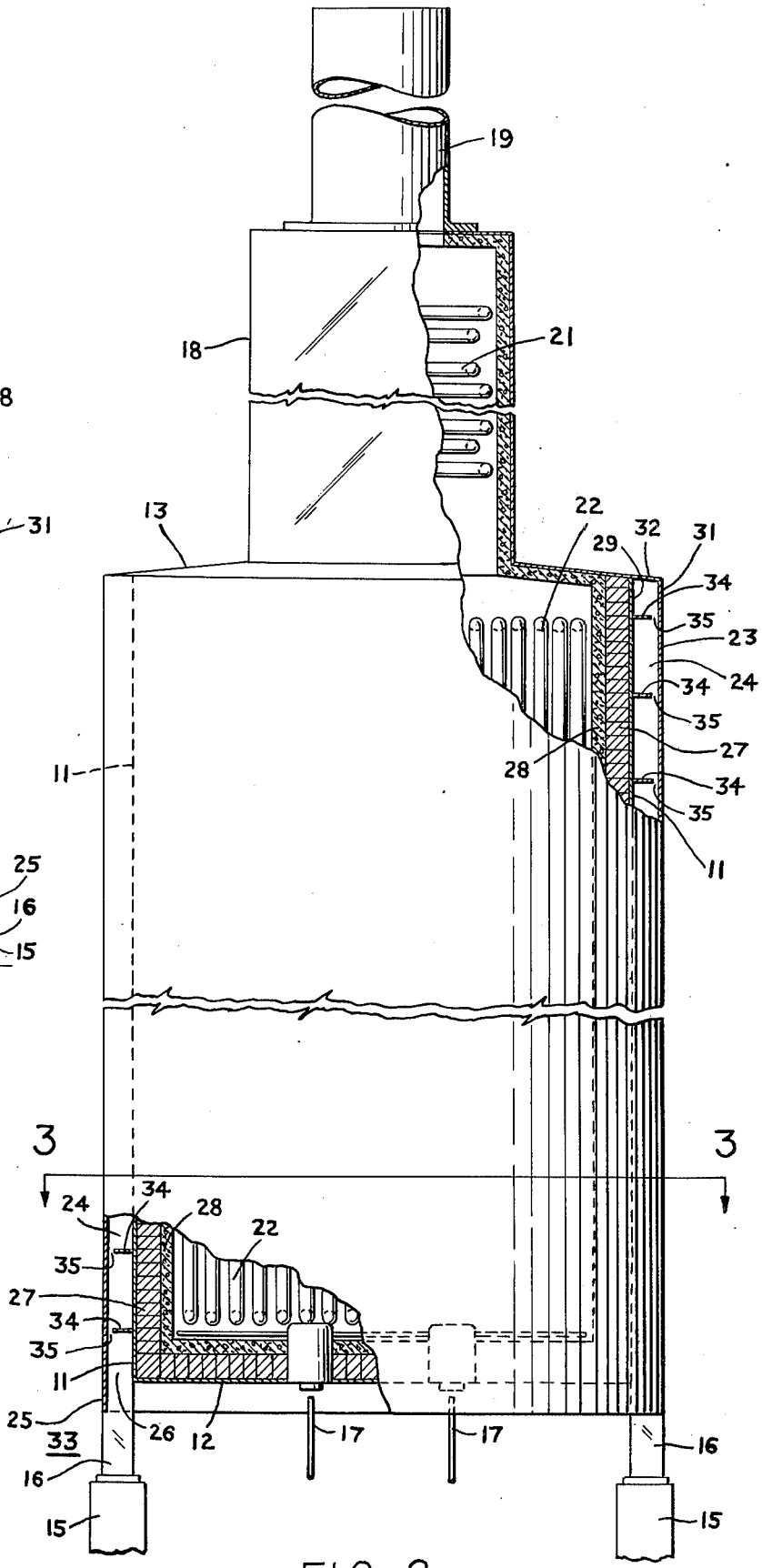
FIG. 2 is an elevational view broken and partly sectioned to an enlarged scale of the heater of FIG. 1.
Figure 3:
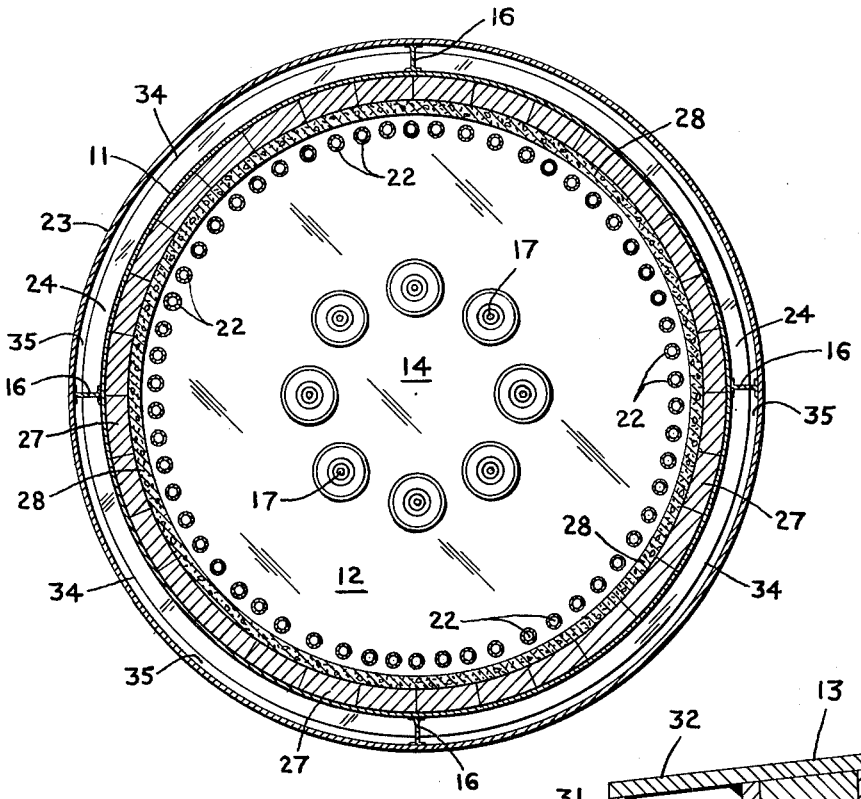
FIG. 3 is a sectional view taken along line 3—3 of FIG. 2.
Figure 4:
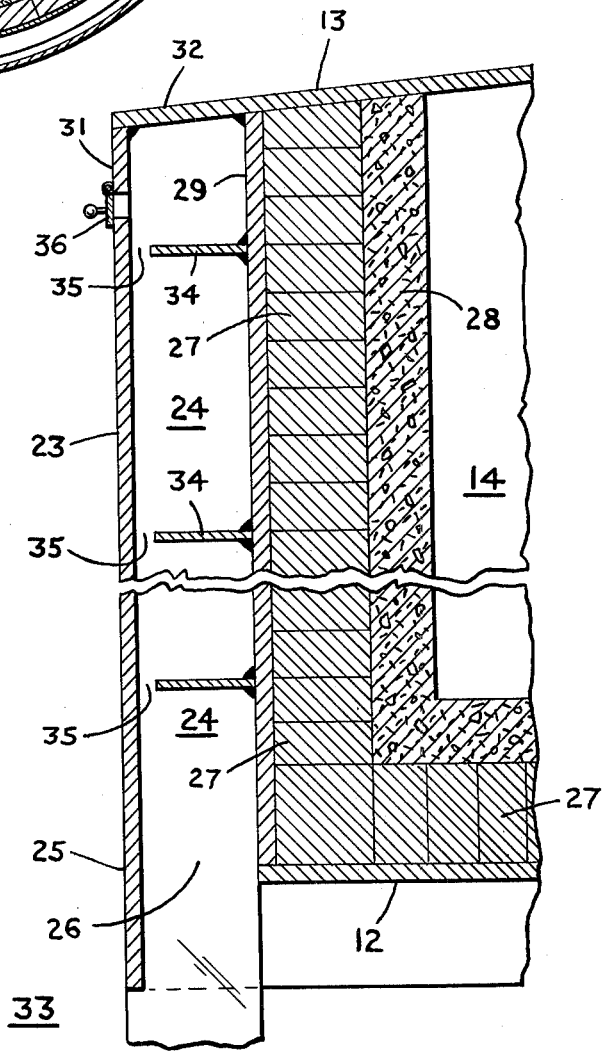
FIG. 4 is a broken sectional view showing details of the wall according to this invention.

As seen in the drawings a heater includes a vertical cylindrical inner metal casing 11 (although boxlike heaters can also employ this invention) with a bottom 12 and a top 13 all of which enclose a combustion chamber 14. The heater is supported on piers 15 by means of structural members 16 and the heater is provided with suitable platforming and associated ladders or stairs (not shown). Burners 17 penetrate via the bottom 12 into the combustion chamber 14. A convection box 18 is mounted above the inner casing 11 and a stack 19 is formed thereabove, so that hot combustion gases pass from the combustion chamber 14 through the convection box 18 and then up the stack 19. One or more process fluids to be heated pass through the heater generally in countercurrent noncontact heat exchange relationship with the hot combustion gases. A process fluid typically flows through a convection tube bundle 21 and then through radiant tubes 22 in the combustion chamber 14.

The crux of the present invention is to provide an outer metal casing 23 spaced from the inner casing 11 to define an air space 24 therebetween. The outer casing 23 is provided at its lower end 25 with an air opening 26 which allows air into and out of the air space 24. The inner casing 11 is lined internally with refractory which can be some combination of bricks 27 and castable refractory 28, or in some cases either brick 27 or castable refractory 28. By techniques well known in the art the refractory lining is selected so as to maintain the temperature of the inner casing 11 above the dew points of $SO_2$ and $SO_3$. The upper end 29 of the inner casing 11 is joined to the upper end 31 of the outer casing 23 in sealed engagement by means of a closure member 32 so that the air space 24 is restricted in access to ambient air 33 and so that the air space 24 is substantially protected from wind, rain, and the like. Horizontally oriented metal baffles 34 are connected to the inner casing 11 and extend outwardly into the air space 24 to restrict circulation of air therein. The baffles 34 are spaced from the outer casing 23 to define restricted openings 35. An adjustable opening 36 is disposed on the outer casing 23 at the upper end 31 so as to control the air flow, when needed.

It will be apparent to those familiar with design of process heaters that wide deviations may be made from the preferred embodiment herein described, without departing from the main theme of invention set forth in claims which follow.

We claim:

1. A wall for a direct fired heater and comprising in combination:

a metal inner casing with an inner refractory lining, a metal outer casing spaced from the inner casing to provide an air space therebetween, the outer casing being provided with an air opening which allows air into the air space; and a plurality of horizontally oriented metal baffles connected to the inner casing and extending outward into the air space, the baffles spaced from the outer casing, where by heat loss due to convection by air current is minimized.

2. The wall of claim 1 with the inner casing lined internally with a multilayer refractory lining.

3. The wall of claim 2 with the refractory selected so as to maintain the temperature of the inner casing above the dew point of $SO_2$ and $SO_3$.

4. The wall of claim 3 with the outer casing having a lower end and the inner and outer casing each having an upper end adjacent to each other, the upper ends joined, the air opening located in the vicinity of the lower end of the outer casing.

5. The wall of claim 3 with the outer casing being provided with an adjustable air vent for control of air flow.

* * * * *